US007603866B2

(12) United States Patent
Watanabe et al.

(10) Patent No.: US 7,603,866 B2
(45) Date of Patent: Oct. 20, 2009

(54) THERMOACOUSTIC APPARATUS

(75) Inventors: Yoshiaki Watanabe, Kyoto (JP); Shinichi Sakamoto, Osaka (JP)

(73) Assignee: The Doshisha, Kyoto-shi (JP)

( * ) Notice: Subject to any disclaimer, the term of this patent is extended or adjusted under 35 U.S.C. 154(b) by 458 days.

(21) Appl. No.: 10/594,275

(22) PCT Filed: Mar. 23, 2005

(86) PCT No.: PCT/JP2005/005221

§ 371 (c)(1),
(2), (4) Date: Sep. 26, 2006

(87) PCT Pub. No.: WO2005/093341

PCT Pub. Date: Oct. 6, 2005

(65) Prior Publication Data

US 2007/0220903 A1 Sep. 27, 2007

(30) Foreign Application Priority Data

Mar. 26, 2004 (JP) ..... 2004-091686

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 5,647,216 | A * | 7/1997 | Garrett | 62/6 |
| 5,953,921 | A * | 9/1999 | Garrett | 62/6 |
| 6,032,464 | A | 3/2000 | Swift et al. | |
| 6,164,073 | A * | 12/2000 | Swift et al. | 60/721 |
| 7,404,296 | B2 * | 7/2008 | Watanabe et al. | 62/6 |

FOREIGN PATENT DOCUMENTS

| | | | |
|---|---|---|---|
| JP | 2000-88378 | A | 3/2000 |
| JP | 2002-31423 | A | 1/2002 |
| JP | 2002-535597 | A | 10/2002 |
| JP | 2005-180294 | A | 7/2005 |
| WO | WO 00/43639 | A1 | 7/2000 |

OTHER PUBLICATIONS

International Search Report of PCT/JP2005/005221, date of mailing: Jul. 5, 2005.
Japanese Office Action dated Mar. 11, 2009 of JP 2004-091686.

* cited by examiner

*Primary Examiner*—William C Doerrler
(74) *Attorney, Agent, or Firm*—Westerman, Hattori, Daniels & Adrian, LLP

(57) ABSTRACT

In order to reduce the time until an acoustic wave is generated and perform heat exchange smoothly in a stack, a thermoacoustic apparatus 1 includes a first stack 3*a* sandwiched between a first high-temperature-side heat exchanger 4 and a first low-temperature-side heat exchanger 5 and a second stack 3*b* sandwiched between a second high-temperature-side heat exchanger 6 and a second low-temperature-side heat exchanger 7 in the inside of a loop tube 2, wherein a standing wave and a traveling wave are generated through self excitation by heating the first high-temperature-side heat exchanger 4, the second low-temperature-side heat exchanger 7 is cooled by the standing wave and the traveling wave, or/and a standing wave and a traveling wave are generated by cooling the first low-temperature-side heat exchanger 5, and the second high-temperature-side heat exchanger 6 is heated by the standing wave and the traveling wave. The standing wave and the traveling wave are generated in the state in which helium having a high sound velocity, a small Prandtl number, and a small specific gravity is enclosed in the loop tube and, thereafter, argon having a low sound velocity, a large Prandtl number, and a small specific gravity is injected.

10 Claims, 8 Drawing Sheets

THERMOACOUSTIC APPARATUS

TECHNICAL FIELD

The present invention relates to a thermoacoustic apparatus capable of cooling or heating an object through the use of thermoacoustic effect.

BACKGROUND ART

Known technologies of a heat exchange apparatus through the use of thermoacoustic effect include the technologies described in the following Patent Document 1, Non-Patent Document 1, and the like.

The apparatus described in Patent Document 1 relates to a cooling apparatus through the use of thermoacoustic effect. This apparatus is configured to include a first stack sandwiched between a high-temperature-side heat exchanger and a low-temperature-side heat exchanger and a regenerator sandwiched between a high-temperature-side heat exchanger and a low-temperature-side heat exchanger in the inside of a loop tube, in which helium, argon, or a mixed gas thereof is enclosed, where the low-temperature-side heat exchanger on the regenerator side is cooled by a standing wave and a traveling wave generated through self excitation by heating the high-temperature-side heat exchanger on the first stack side.

Likewise, Non-Patent Document 1 discloses an experimental study of a cooling apparatus through the use of thermoacoustic effect. The cooling apparatus used in this experiment is also configured to include a loop tube enclosing helium, argon, or a mixed gas thereof in the inside, a first stack sandwiched between a heater (high-temperature-side heat exchanger) and a low-temperature-side heat exchanger, and a second stack disposed at a position opposite to the first stack. A temperature gradient is generated in the first stack by heating the heater (high-temperature-side heat exchanger) disposed on the first stack side and, in addition, circulating running water in the low-temperature-side heat exchanger, and an acoustic wave is generated through self excitation in a direction opposite to the temperature gradient. The resulting acoustic energy is transferred to the regenerator side through the loop tube, and on the second stack side, thermal energy is transferred in the direction opposite to the direction of the acoustic energy on the basis of the energy conservation law, so as to cool the vicinity of a thermometer disposed on the other end side of the second stack. According to this document, a temperature reduction of about 16° C. has been ascertained under a predetermined condition at the portion where the thermometer has been disposed.

Patent Document 1: Japanese Unexamined Patent Application Publication No. 2000-88378

Non-Patent Document 1: Shinichi SAKAMOTO, Kazuhiro MURAKAMI, and Yoshiaki WATANABE, "Netsuonkyou Koukao Mochiita Onkyoureikyaku Genshouno Jikkenteki Kentou (Experimental Study of Acoustic Cooling Phenomenon Through the Use of Thermoacoustic Effect)", The Institute of Electronics, Information and Communication Engineers, TECHNICAL REPORT OF IEICE. US2002-118 (2003-02)

DISCLOSURE OF INVENTION

Problems to be Solved by the Invention

In the apparatus through the use of the above-described thermoacoustic effect, efficient energy conversion is required as in general heat exchange apparatuses and the like. In order to improve the efficiency of the energy conversion of the apparatus through the use of this thermoacoustic effect, the time period from heating to generation of the standing wave and the traveling wave must be reduced. Furthermore, after the acoustic wave is generated, the efficiency of energy conversion must be improved. Therefore, with respect to known apparatuses, helium having a small Prandtl number, argon having a large Prandtl number, or a mixed gas thereof is enclosed in the inside of the loop tube and, thereby, a reduction of the time until the standing wave and the traveling wave are generated and an improvement in acoustic energy and thermal energy conversion efficiencies are intended.

However, if helium having a small Prandtl number is used as in the above-described known apparatus, although the time until the generation of an acoustic wave can be reduced, the sound velocity of the resulting acoustic wave is increased, and there is a problem in that heat exchange with a stack inner wall cannot be performed smoothly. If a working fluid, e.g., argon, having a relatively large Prandtl number is used, although the sound velocity can be decreased due to the viscosity thereof, there is a problem in that the time until the generation of an acoustic wave is increased conversely. On the other hand, when a mixed gas of helium and argon is enclosed, there is a problem in that the sound velocity may become too high or, conversely, the time until the generation of an acoustic wave may be excessively increased depending on the mixing ratio. Furthermore, even when the ratio of the mixed gas is in an optimized condition, the mixed gas may be separated into upper and lower portions after the loop tube is stood for a long time, and there are problems in that, for example, the same effect as in the initial homogeneously mixed state may not be exerted.

The present invention has been made in consideration of the above-described problems. Accordingly, it is an object to provide a thermoacoustic apparatus and the like capable of reducing the time until an acoustic wave is generated and performing heat exchange smoothly in a stack.

Means for Solving the Problems

In order to overcome the above-described problems, a thermoacoustic apparatus according to an aspect of the present invention includes a first stack sandwiched between a first high-temperature-side heat exchanger and a first low-temperature-side heat exchanger and a second stack sandwiched between a second high-temperature-side heat exchanger and a second low-temperature-side heat exchanger in the inside of a loop tube, wherein a standing wave and a traveling wave are generated through self excitation by heating the above-described first high-temperature-side heat exchanger, the above-described second low-temperature-side heat exchanger is cooled by the standing wave and the traveling wave, or/and a standing wave and a traveling wave are generated by cooling the above-described first low-temperature-side heat exchanger, and the above-described second high-temperature-side heat exchanger is heated by the standing wave and the traveling wave, while the thermoacoustic apparatus includes a mixing device for injecting and mixing a working fluid different from a first working fluid after the first working fluid is enclosed in the inside of the loop tube.

According to this configuration, since the first working fluid is enclosed, and the working fluid different from the first working fluid is injected, for example, immediately before a sound is generated, immediately after the sound is generated, or after the sound rises suddenly, the working fluid in the loop tube can be brought into a homogeneous state during the use, and the gases can be mixed into an optimum state in consideration of a balance between the generation of sound and the output of heat.

When the working fluid is mixed, the working fluid, which has a low sound velocity, is injected afterward into the working fluid, which has a high sound velocity, enclosed in the loop tube in advance.

According to this configuration, the acoustic wave can be generated rapidly, and after the acoustic wave is generated, transition to a state, in which the efficiency of heat exchange is high, is possible.

With respect to forms thereof, for example, the working fluid having a small specific gravity is enclosed in advance and the working fluid having a large specific gravity is injected afterward.

For another form, the working fluid having a large Prandtl number is injected afterward into the working fluid having a small specific gravity enclosed in the loop tube in advance.

According to this configuration, under a predetermined condition, an acoustic wave can be generated rapidly by using the working fluid having a small Prandtl number (that is, a working fluid having a small kinematic viscosity coefficient relative to a thermal diffusion coefficient), and a state most suitable for the efficiency of heat exchange can be brought about by injecting the working fluid having a large Prandtl number (that is, a working fluid having a small thermal diffusion coefficient relative to a kinematic viscosity coefficient).

The loop tube including a plurality of linear tube portions, which stand relative to the ground, and connection tube portions connected between the plurality of linear tube portions is used, and the mixing device is disposed above the center of the loop tube.

According to this configuration, in the case where working fluids having different weights relative to each other are mixed, working fluids can be mixed homogeneously in the loop tube by injecting a heavier working fluid afterward from above.

Alternatively, the loop tube is configured to be bilaterally symmetric and include a plurality of linear tube portions, which stand relative to the ground, and connection tube portions connected between the plurality of linear tube portions, and the mixing device is disposed at the center of the upper connection tube portion.

According to this configuration, since the working fluid is injected from the center of the upper side of the loop tube configured to be bilaterally symmetric, the injected working fluid is uniformly divided into the right and the left, and the entire loop tube can be mixed homogeneously.

Furthermore, a sound detection device for detecting generation of a sound is disposed, and injection of the working fluid is started when the generation of a sound in the loop tube is detected by this sound detection device or when a variation in the state of sound is detected.

According to this configuration, since the working fluid is injected after the sound is generated or after the sound rises suddenly, a state, in which the efficiency of heat exchange is high, can be brought about rapidly after the sound is generated or after the sound rises suddenly.

In addition, a pressure measuring device for measuring a pressure in the loop tube is disposed, and injection of the working fluid is stopped when a predetermined pressure is measured by this pressure measuring device.

According to this configuration, the pressure in the loop tube can be kept at a constant value, and it becomes possible to prevent a problem in that, for example, the efficiency of heat exchange varies due to pressure variation in each use.

The injection of the working fluid is stopped on the basis of the variation over time of heat output from the second high-temperature-side heat exchanger or the second low-temperature-side heat exchanger.

According to this configuration, it becomes possible to prevent a problem in that the working fluid is continued being injected even when the variation in the heat output from the second high-temperature-side heat exchanger is terminated.

When the working fluid composed of a working fluid lighter than air and a working fluid heavier than air is used, an opening portion for releasing the working fluid heavier than air is disposed at the lower end portion of the loop tube.

According to this configuration, for example, when helium, which is lighter than air, and argon, which is heavier than air, are used, argon can simply be released from the opening portion disposed at the lower end and, therefore, it is not necessary to replace the entire working fluid.

Advantages

The thermoacoustic apparatus according to an aspect of the present invention includes the first stack sandwiched between the first high-temperature-side heat exchanger and the first low-temperature-side heat exchanger and the second stack sandwiched between the second high-temperature-side heat exchanger and the second low-temperature-side heat exchanger in the inside of the loop tube, wherein a standing wave and a traveling wave are generated through self excitation by heating the above-described first high-temperature-side heat exchanger, the above-described second low-temperature-side heat exchanger is cooled by the standing wave and the traveling wave, or/and a standing wave and a traveling wave are generated through self excitation by cooling the above-described first low-temperature-side heat exchanger, and the above-described second high-temperature-side heat exchanger is heated by the standing wave and the traveling wave, while the thermoacoustic apparatus includes the mixing device for injecting and mixing the working fluid different from the first working fluid after the first working fluid is enclosed in the inside of the loop tube. Consequently, the working fluids in the loop tube can be mixed homogeneously and, in addition, an optimum mixing state can be achieved while the generation of sound and output of heat are adjusted.

Best Mode for Carrying Out the Invention

A first embodiment of a thermoacoustic apparatus 1 according to an aspect of the present invention will be described below with reference to drawings.

As shown in FIG. 1, the thermoacoustic apparatus 1 in the present embodiment includes a first stack 3*a* sandwiched between a first high-temperature-side heat exchanger 4 and a first low-temperature-side heat exchanger 5 and a second stack 3*b* sandwiched between a second high-temperature-side heat exchanger 6 and a second low-temperature-side heat exchanger 7 in the inside of a loop tube 2 configured to take on a nearly rectangular shape as a whole. A standing wave and a traveling wave are generated through self excitation by heating the first high-temperature-side heat exchanger 4 on the first stack 3*a* side, and the second low-temperature-side heat exchanger 7 disposed on the second stack 3*b* side is cooled by propagating the standing wave and the traveling wave to the second stack 3*b* side.

In the present embodiment, in order to reduce the time from the start of heating of the first high-temperature-side heat exchanger 4 until the standing wave and the traveling wave are generated and increase the efficiency of energy conversion due to the generated standing wave and the traveling wave, initially a first working fluid having a high sound velocity, a small Prandtl number, and a small specific gravity is enclosed in the loop tube 2, and after a standing wave and a traveling wave are generated, a second working fluid having a low sound velocity, a large Prandtl number, and a large specific gravity is injected.

In general, the Prandtl number Pr is represented as described below.

$$P_r = \nu(\text{kinematic viscosity coefficient})/\kappa(\text{thermal diffusion coefficient}) = C_p \mu g/\lambda$$

$C_p$: specific heat at constant pressure, μ: viscosity, g: acceleration of gravity, λ: thermal conductivity Therefore, when the thermal diffusion coefficients κ of different working fluids are the same, the working fluid having a smaller Prandtl number exhibits a smaller kinematic viscosity coefficient ν. Consequently, the time until an acoustic wave is generated is reduced, and the sound velocity of the resulting acoustic wave is increased. On the other hand, the working fluid having a larger Prandtl number exhibits a relatively larger kinematic viscosity coefficient ν (thermal diffusion coefficient κ is decreased), and it takes a time until an acoustic wave is generated. However, when the Prandtl number is large, the efficiency of heat exchange is improved. With respect to the relationship between the specific gravity and the sound velocity, when the specific gravity is small, the sound velocity tends to be increased. Therefore, in the present embodiment, a working fluid, e.g., helium, having a high sound velocity, a small Prandtl number, and a small specific gravity is enclosed in the loop tube 2 initially and, thereby, a standing wave and a traveling wave are generated rapidly. Thereafter, a working fluid, e.g., argon, having a low sound velocity, a large Prandtl number, and a large specific gravity is injected appropriately so as to improve the efficiency of heat exchange. The thermoacoustic apparatus 1 in the present embodiment will be described below in detail.

The loop tube 2 constituting the thermoacoustic apparatus 1 includes a pair of linear tube portions 2*a* opposite to each other, which are disposed along the vertical direction relative to the ground, and connection tube portions 2*b* connected between these linear tube portions 2*a*, and is composed of a metal pipe or the like. The material for this loop tube 2*a* is not limited to the metal or the like, and may be transparent glass, a resin, or the like. When the loop tube 2*a* is composed of a material, such as the transparent glass, the resin, or the like, positions of the first stack 3*a* and the second stack 3*b* can be checked and the status in the tube can easily be observed in an experiment or the like.

For the lengths of the thus disposed linear tube portion 2*a* and the connection tube portion 2*b*, when the length of the linear tube portion 2*a* is assumed to be La and the length of the connection tube portion 2*b* is assumed to be Lb, La and Lb are set within the range satisfying $$1:0.01 \leqq La:Lb < 1:1.$$

However, it is preferable that the linear tube portion 2*a* is made as long as possible, and La and Lb are set within the range satisfying $$1:0.01 \leqq La:Lb \leqq 1:0.5.$$

When the length of the linear tube portion 2*a* is set at a large value, the surface wavefront of an acoustic wave generated from the first stack 3*a* can be stabilized as rapid as possible.

In the inside of the thus configured loop tube 2, the first stack 3*a* sandwiched between the first high-temperature-side heat exchanger 4 and the first low-temperature-side heat exchanger 5 and the second stack 3*b* sandwiched between the second high-temperature-side heat exchanger 6 and the second low-temperature-side heat exchanger 7 are disposed.

This first stack 3*a* is configured to take on a cylindrical shape which touches the inner wall of the loop tube 2, and is formed from a material, e.g., ceramic, sintered metal, gauze, or nonwoven metal fabric, which has a large heat capacity. The first stack 3*a* is configured to have multiple holes penetrating in the axis direction of the loop tube 2. As shown in FIG. 2 and FIG. 3, a stack 3*c* including a plurality of connection channels 30 arranged in such a way that the inner diameters of individual connection channels are increased one after another as the position of the connection channel approaches the outside from the center or a stack 3*d* including connection channels 30 arranged in such a way that the inner diameters of individual connection channels are decreased one after another as the position of the connection channel approaches the outside from the center may be used in place of this first stack 3*a*. Alternatively, as shown in FIG. 4 and FIG. 5, a stack 3*e* including meandering connection channels 30 (connection channel 30 indicated by a thick line) produced by laying, for example, a plurality of fine spherical ceramic, a stack 3*f* including connection channels 30 arranged in such a way that the flow path lengths of individual connection channels are decreased one after another as the position of the connection channel approaches the inner perimeter surface of the loop tube 2, or the like may be used.

Both the first high-temperature-side heat exchanger 4 and the first low-temperature-side heat exchanger 5 are composed of a thin metal, and are configured to include through holes for transmitting the standing wave and the traveling wave in the inside thereof. Among these heat exchangers, the first high-temperature-side heat exchanger 4 is configured to be heated by an electric power supplied from the outside, waste heat, unused energy, or the like. On the other hand, the first low-temperature-side heat exchanger 5 is set at a temperature relatively lower than that of the first high-temperature-side heat exchanger 4 by circulating water around it.

The first stack 3*a* sandwiched between the first high-temperature-side heat exchanger 4 and the first low-temperature-side heat exchanger 5, as described above, is disposed below the center of the linear tube portion 2*a* while the first high-temperature-side heat exchanger 4 is disposed on the upper side. The first stack 3*a* is disposed below the center of the linear tube portion 2*a*, as described above, on the grounds that an acoustic wave is generated rapidly through the use of an updraft generated when the first high-temperature-side heat exchanger 4 is heated and that a warm working fluid generated when the first high-temperature-side heat exchanger 4 is heated is prevented from entering the first stack 3*a*. A large temperature gradient is formed in the first stack 3*a* by preventing the warm working fluid from entering the first stack 3*a*, as described above.

With respect to the condition for the generation of the acoustic wave through self excitation in the first stack 3*a*, in the case where the working fluid flows in the first stack 3*a*, when a flow path radius of the parallel channels is assumed to be r, an angular frequency of the working fluid is assumed to be ω, a temperature diffusion coefficient is assumed to be α, and a temperature relaxation time is assumed to be $\tau$ ($=r^2/2\alpha$), the acoustic wave can be generated through self excitation most efficiently when $\omega\tau$ is within the range of 0.2 to 20. Therefore, r, ω, and τ are set in such a way as to satisfy these relationships. Furthermore, when one end of the linear tube portion 2*a* in the upper left of the loop tube 2 is connected to one end of the connection tube portion 2*b* in FIG. 1, an intersection of the respective center axes is assumed to be a start point X of a circuit, and an entire length of the circuit is assumed to be 1.00, the acoustic wave can be generated through self excitation more rapidly and efficiently by setting the center of the first stack at a position corresponding to 0.28±0.05 relative to the entire length of the circuit in a counterclockwise direction from the start point X.

On the other hand, similarly to the first stack 3*a*, the second stack 3*b* is configured to take on a cylindrical shape which touches the inner wall of the loop tube 2, and is formed from a material, e.g., ceramic, sintered metal, gauze, or nonwoven metal fabric, which has a large heat capacity. The second stack 3*b* is configured to have multiple holes penetrating in the axis direction of the loop tube 2. This second stack 3*b* is disposed in such a way that when a first peak of the pressure variation of the working fluid along the loop tube 2 is present in the vicinity of the first stack 3*a*, and a second peak is present at a position corresponding to about one-half the entire length of the circuit, the center of the second stack 3*b* is positioned past the second peak. With respect to the structure of this second stack 3*b*, as shown in FIG. 2 and FIG. 3, a stack 3*c* including a plurality of connection channels 30 arranged in such a way that the inner diameters of individual connection channels are increased one after another as the position of the connection channel approaches the outside from the center or a stack 3*d* including connection channels 30 arranged in such a way that the inner diameters of individual connection channels are decreased one after another as the position of the connection channel approaches the outside from the center may be used similarly to that for the first stack 3*a*. Alternatively, as shown in FIG. 4 and FIG. 5, a stack 3*e* including meandering connection channels 30 (connection channel 30 indicated by a thick line) produced by laying, for example, a plurality of fine spherical ceramic, a stack 3*f* including connection channels 30 arranged in such a way that the flow path lengths of individual connection channels are decreased one after another as the position of the connection channel approaches the inner perimeter surface of the loop tube 2, or the like may be used.

Likewise, both the second high-temperature-side heat exchanger 6 and the second low-temperature-side heat exchanger 7 disposed on the second stack 3*b* side are composed of a thin metal, and are configured to include through holes for transmitting the standing wave and the traveling wave in the inside thereof. Water is circulated around the second high-temperature-side heat exchanger 6 and, in addition, an object of cooling is connected to the second low-temperature-side heat exchanger 7. It is believed that the object of cooling is outside air, a heat-producing household electric appliance, a CPU of a personal computer, and the like. However, objects other than them may be cooled.

In the inside of the thus configured loop tube 2, helium serving as the first working fluid having a small Prandtl number and argon serving as the second working fluid having a Prandtl number larger than that of the first working fluid are enclosed.

When these working fluids are enclosed, if helium having a high sound velocity, a small Prandtl number, and a small specific gravity is used, the time until an acoustic wave is generated can be reduced. However, the sound velocity is increased and the heat exchange with the stack inner wall cannot be performed smoothly. Conversely, if argon or the like having a low sound velocity, a large Prandtl number and a small specific gravity is used, the viscosity is increased and an acoustic wave cannot be generated rapidly. Consequently, in the present embodiment, in order to generate an acoustic wave rapidly, helium is enclosed in the inside of the loop tube 2*a* initially, and argon is injected after a standing wave and a traveling wave are generated. In the case where the above-described second working fluid is injected, the procedure is as described below.

As shown in FIG. 1, a helium gas injection apparatus 9*a* filled in with helium and an argon gas injection apparatus 9*b* filled in with argon are disposed above the loop tube 2*a* and these gas injection apparatus 9*a* and 9*b* are connected to a common injection hole 9*d*. This injection hole 9*d* is disposed at the center portion of the upper connection tube portion 2*b*, and respective working fluids can be injected from the common injection hole 9*d* into the loop tube 2 by opening a valve 9*c* of the helium gas injection apparatus 9*a* or a valve 9*c* of the argon gas injection apparatus 9*b*. Under such a condition, the valve 9*c* of the helium gas injection apparatus 9*a* is opened so as to enclose helium in the loop tube 2. Under the above-described condition in which helium is enclosed, water is circulated around the first low-temperature-side heat exchanger 5 and the second high-temperature-side heat exchanger 6 and, in addition, the first high-temperature-side heat exchanger 4 side is heated. Consequently, a temperature gradient is generated in the first stack 3*a* due to the temperature difference between the first high-temperature-side heat exchanger 4 and the first low-temperature-side heat exchanger 5, and the working fluid begins wandering minutely. Subsequently, this working fluid begins vibrating largely and circulates in the loop tube 2. Since the helium gas having a high sound velocity, a small Prandtl number, and a small specific gravity is enclosed in the loop tube 2 at this time, a standing wave and a traveling wave can be generated rapidly. After the standing wave and the traveling wave are generated, the valve 9*c* of the argon gas injection apparatus 9*b* is opened so as to inject argon having a low sound velocity, a large Prandtl number and a large specific gravity from the upper side of the loop tube 2. Argon having a relatively large specific gravity moves downward in the loop tube 2, and is mixed homogeneously with helium having a small specific gravity at that time. The acoustic energy generated from the first stack 3*a* under the resulting mixed condition is transferred in the direction opposite to the transfer direction (direction from the first high-temperature-side heat exchanger 4 toward the first low-temperature-side heat exchanger 5) of the thermal energy in the first stack 3*a*, that is, in the direction from the first low-temperature-side heat exchanger 5 toward the first high-temperature-side heat exchanger 4, on the basis of the energy conservation law, and is transferred to the second stack 3*b* side through the loop tube 2. The working fluid is allowed to expand or shrink due to pressure variation and volume variation of the working fluid based on the standing wave and the traveling wave on the second stack 3*b* side. The thermal energy generated at that time is transferred from the second low-temperature-side heat exchanger 7 toward the second high-temperature-side heat exchanger 6 side, that is, in the direction opposite to the transfer direction of the acoustic energy. In this manner, the second low-temperature-side heat exchanger 7 is cooled and the intended object is cooled.

The following method can be used as the method in the case where argon is injected as described above.

As shown in FIG. 6, a sound detection device 8*a* for detecting generation of a sound is disposed on the outer perimeter portion or in the inside of the loop tube 2. The valve 9*c* of the argon gas injection apparatus 9*b* is opened by an output signal from the sound detection device 8*a*. It is believed that examples of the sound detection device 8*a* include a method for detecting an acoustic wave with a specific frequency and a method for detecting vibration of the loop tube 2. However, various methods other than them may be used.

The injection from the argon gas injection apparatus 9*b* is stopped as described below.

A pressure measuring device 90, e.g., a pressure gauge, for measuring the pressure in the loop tube 2 is disposed, and the valve 9*c* of the argon gas injection apparatus 9*b* is closed when a predetermined pressure value is measured with this pressure measuring device 90. This pressure is set within the range of, for example, 0.01 MPa to 5 MPa. In the case where the loop tube 2 is configured to be relatively small, the pressure is set at a small value in order to reduce the influence of viscosity.

Furthermore, not only the valve 9*c* of the argon gas injection apparatus 9*b* is controlled by the pressure measuring device 90, but also a heat variation control device 91 for controlling the closing and opening of the valve 9*c* on the basis of the variation in heat output from the second low-temperature-side heat exchanger 7 may be disposed. In the case where this heat variation control device 91 is used, for example, the control is performed in such a way that the valve 9*c* of the argon gas injection apparatus 9*b* is closed and the injection is stopped when the variation over time of the heat output from the second low-temperature-side heat exchanger 7 becomes a predetermined value or less. According to this configuration, needless injection of argon is avoided, and the gas can be saved. In the case where the closing and opening of the valve 9*c* is controlled on the basis of the variation over time of heat, the above-described control of the closing and opening of the valve 9*c* by the pressure may be performed in combination therewith. According to this configuration, unlimited pressurization is avoided, and breakage and the like of the apparatus 1 can be prevented.

Moreover, in the case where the above-described apparatus 1 is used, a closable opening portion 2*c* is disposed in the loop tube 2 in such a way that degasification operation and fresh mixing can be performed in each use. It is preferable that this opening portion 2*c* is disposed in the lower end portion of the loop tube 2. After the use of apparatus 1 is finished, this opening portion 2*c* is opened, so that the working fluid having a relatively heavier specific gravity is released into air. According to this configuration, argon having a relatively heavier specific gravity is settled in a lower portion of the loop tube 2 when a certain time has elapsed after the use is finished, and argon heavier than air is simply released into air from the opening portion 2*c*. In the case where helium is filled in again from the upper side in the next use, the air entered into the loop tube 2 can be pushed out and released from the lower opening portion 2*c* and, thereby, the density of helium in the loop tube 2 can be increased.

According to the above-described embodiment, the gas injection apparatus 9*b* is disposed, the standing wave and the traveling wave are generated through self excitation under the condition in which one working fluid is enclosed in the inside of the loop tube 2 and, thereafter, another working fluid different from the above-described working fluid is injected with the apparatus. Consequently, it becomes possible to set at a state in best balance from the view point of the generation of acoustic wave and the efficiency of energy conversion.

In the present embodiment, helium having a high sound velocity, a small Prandtl number, and a small specific gravity is enclosed in advance and, thereafter, argon having a low sound velocity, a large Prandtl number, and a large specific gravity is injected. Consequently, an acoustic wave is generated rapidly by helium and, in addition, after the acoustic wave is generated, it is possible to bring about a state most suitable for the efficiency of heat exchange by argon.

The loop tube 2 including a plurality of linear tube portions 2*a*, which are disposed vertically relative to the ground, and connection tube portions 2*b* connected between these linear tube portions 2*a* is used, and the argon gas injection apparatus 9*b* is disposed above the center of the loop tube 2. Consequently, the working fluids can be mixed homogeneously by injecting argon heavier than helium from above.

Since the loop tube 2 is configured to be bilaterally symmetric and the injection hole 9*d* of the gas injection apparatus 9*b* is disposed at an upper side of the center portion of the loop tube 2, argon injected from the injection hole 9*d* is divided into the right and the left, and the working fluid can be injected into the loop tube uniformly. Consequently, variations in acoustic wave generation and variations in heat exchange can be eliminated.

Furthermore, a sound detection device 8*a* for detecting generation of a sound is disposed, and the working fluid having a large Prandtl number is injected when the sound generated in the loop tube is detected by this sound detection device. Consequently, the generation time of acoustic wave can be reduced and, in addition, the efficiency of heat exchange can be improved.

Moreover, the pressure measuring device 90 is disposed, and injection of the working fluid is stopped when the pressure in the loop tube 2 reaches a predetermined value. Consequently, the pressure in the loop tube can always be kept at a constant value, and it becomes possible to prevent a problem in that the efficiency of heat exchange varies due to pressure variation in each use.

In another form of the case where the injection of the working fluid is stopped, the injection of the working fluid is stopped on the basis of the variation over time of heat output from the second high-temperature-side heat exchanger 6. Consequently, it becomes possible to avoid waste, such that the injection of the working fluid is continued needlessly.

In the case where argon, which is heavier than air is injected into helium, which is lighter than air, since the opening portion 2*c* for releasing argon is disposed at the lower end portion of the loop tube 2, argon can simply be released into air by opening the opening portion 2*c* and, therefore, it is not necessary to replace the entire working fluid.

The present invention is not limited to the above-described embodiments, and can be carried out in various forms.

For example, in the above-described thermoacoustic apparatus 1, the acoustic wave is generated through self excitation by the temperature gradient provided in the first stack 3*a*. In order to facilitate the acoustic wave through self excitation, an acoustic wave generator 8*b* may be disposed on the outer perimeter portion or in the inside of the loop tube 2. This acoustic wave generator 8*b* is composed of a speaker, a piezoelectric element, or other devices which forcedly vibrate the working fluid from the outside. It is preferable that the acoustic wave generator 8*b* is attached with a distance of one-half or one-quarter the wavelength of the standing wave and the traveling wave generated. Preferably, the acoustic wave generator 8*b* is disposed in such a way as to forcedly vibrate the working fluid in the axis direction of the loop tube 2 in correspondence with the movement direction of the standing wave and the traveling wave. When the acoustic wave generator 8*b* is disposed as described above, the generation time of the standing wave and the traveling wave can be reduced, and the second low-temperature-side heat exchanger 7 can be cooled.

In the case where satisfactory cooling effect cannot be attained by the above-described thermoacoustic apparatus 1 alone, a thermoacoustic system 100, in which a plurality of thermoacoustic apparatuses 1 are connected, as shown in FIG. 7, may be used. In FIG. 7, reference numerals 1*a*, 1*b* . . . and in denote thermoacoustic apparatuses 1 configured as described above. These first thermoacoustic apparatus 1*a*, second thermoacoustic apparatus 1*b* . . . and nth thermoacoustic apparatus in are disposed adjacently in series. Gas injection apparatuses 9*a* and 9*b* are disposed so as to be shared among all or a plurality of thermoacoustic apparatuses 1*a*, 1*b* . . . and 1*n*. All first high-temperature-side heat exchangers 4 in these first thermoacoustic apparatuses 1*a* . . . are heated by heaters or the like. On the other hand, respective second low-temperature-side heat exchangers 7 of the thermoacoustic apparatuses 1*a* . . . are connected to first low-temperature-side heat exchangers 5 of the thermoacoustic apparatuses 1*b* . . . adjacent thereto. In this manner, the temperature gradient in the second thermoacoustic apparatus 1*b* can be made larger than the temperature gradient of the first stack 3*a* in the first thermoacoustic apparatus 1*a*. Consequently, the temperature gradient of the thermoacoustic apparatus in can be increased one after another toward the downstream, and the last thermoacoustic apparatus in can output heat at a lower temperature. When the thermoacoustic apparatuses 1*a* . . . are connected as described above, if each of the thermoacoustic apparatuses 1*a* . . . is allowed to generate an acoustic wave through self excitation, it takes significantly much time until a standing wave and a traveling wave are generated in the last thermoacoustic apparatus 1*n*. Consequently, it is preferable that the time until a standing wave and a traveling wave are generated in each of the thermoacoustic apparatuses 1*a* . . . is reduced by disposing acoustic wave generators 8*b*, in particular, on the outer perimeter surface or in the inside of the loop tube 2. In the case where an acoustic wave is generated in each loop tube 2 of the above-described system 100, it is preferable that the valves 9*c* of the gas injection apparatus 9*b* disposed while being shared are controlled, and every time an acoustic wave is generated in each loop tube 2, the valve 9*c* corresponding to the loop tube 2 is opened to inject the working fluid. Likewise, in the case where the injection is stopped, the injection may be stopped by the pressure measuring device 90 or the heat variation control device 91 disposed on a loop tube 2 basis.

In the above-described embodiment, the explanation is conducted with reference to the thermoacoustic apparatus 1 in which the first stack 3*a* side is heated and the second stack 3*b* side is cooled. Conversely, the first stack 3*a* side may be cooled and the second stack 3*b* side may be heated. FIG. 8 shows an example of such a thermoacoustic apparatus 1.

In FIG. 8, the elements indicated by the same reference numerals as those in FIG. 1 to FIG. 6 are elements having the same structures as the elements set forth above. In FIG. 8, a first stack 3*a* is disposed above the center of a linear tube portion 2*a*, and a second stack 3*b* is disposed at an appropriate position in the linear tube portion 2*a* opposite thereto. With respect to the positions of installation of the first stack 3*a* and the second stack 3*b*, it is preferable that these are disposed at the positions at which the installation condition is the same as the condition in the above-described embodiment. Low-temperature heat at minus several tens of degrees or lower is input into a first low-temperature-side heat exchanger 5 and, in addition, an antifreeze liquid is circulated in a first high-temperature-side heat exchanger 4 and a second low-temperature-side heat exchanger 7. Consequently, an acoustic wave is generated through self excitation by the temperature gradient formed in the first stack 3*a* on the basis of the principle of thermoacoustic effect, the surface wavefront is stabilized in the linear tube portion 2*a* set to be relatively long, and a standing wave and a traveling wave are generated rapidly through the use of a downdraft of the low-temperature heat. The acoustic energy of the standing wave and the traveling wave is generated in such a way that the movement direction thereof is a direction opposite to the transfer direction (direction from the first high-temperature-side heat exchanger 4 toward the first low-temperature-side heat exchanger 5) of the thermal energy in the first stack 3*a*. The acoustic energy due to the standing wave and the traveling wave is propagated to the second stack 3*b* side. The working fluid is allowed to repeat expansion and shrinkage due to pressure variation and volume variation of the working fluid based on the standing wave and the traveling wave on the second stack 3*b* side. The thermal energy generated at that time is transferred in the direction opposite to the transfer direction of the acoustic energy, that is, from the second low-temperature-side heat exchanger 7 toward the second high-temperature-side heat exchanger 6 side. In this manner, the second high-temperature-side heat exchanger 6 is heated.

In the present embodiment as well, in order to facilitate the generation of the standing wave and the traveling wave, an acoustic wave generator 8*b* may be disposed on the outer perimeter surface or in the inside of the loop tube 2. Alternatively, the above-described thermoacoustic apparatuses 1 may be connected as shown in FIG. 7, and higher-temperature heat may be output from the thermoacoustic apparatus 1 on the end side.

REFERENCE NUMERALS

Figure 1:
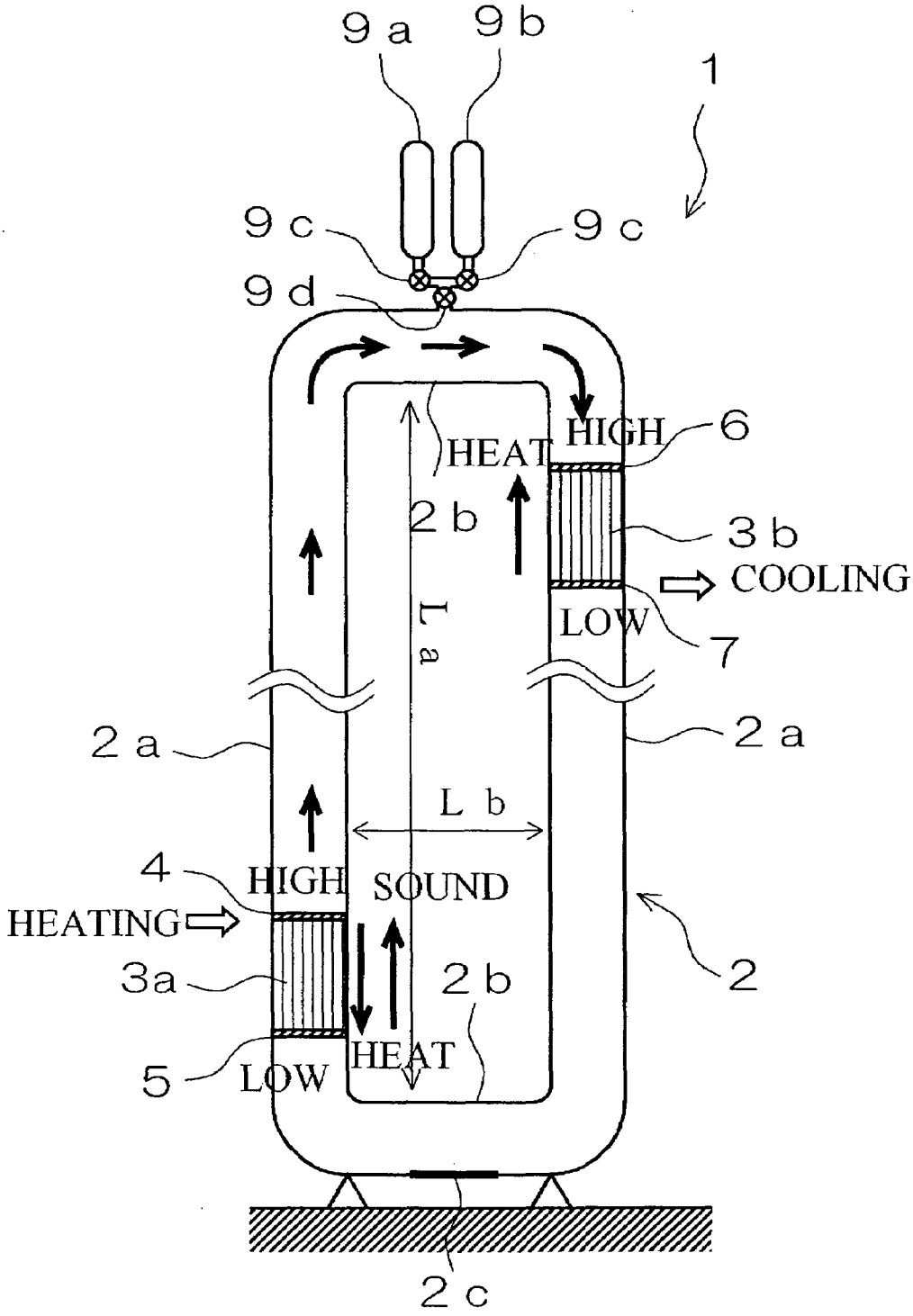
FIG. 1 is a schematic diagram of a thermoacoustic apparatus according to an embodiment of the present invention.
Figure 2:
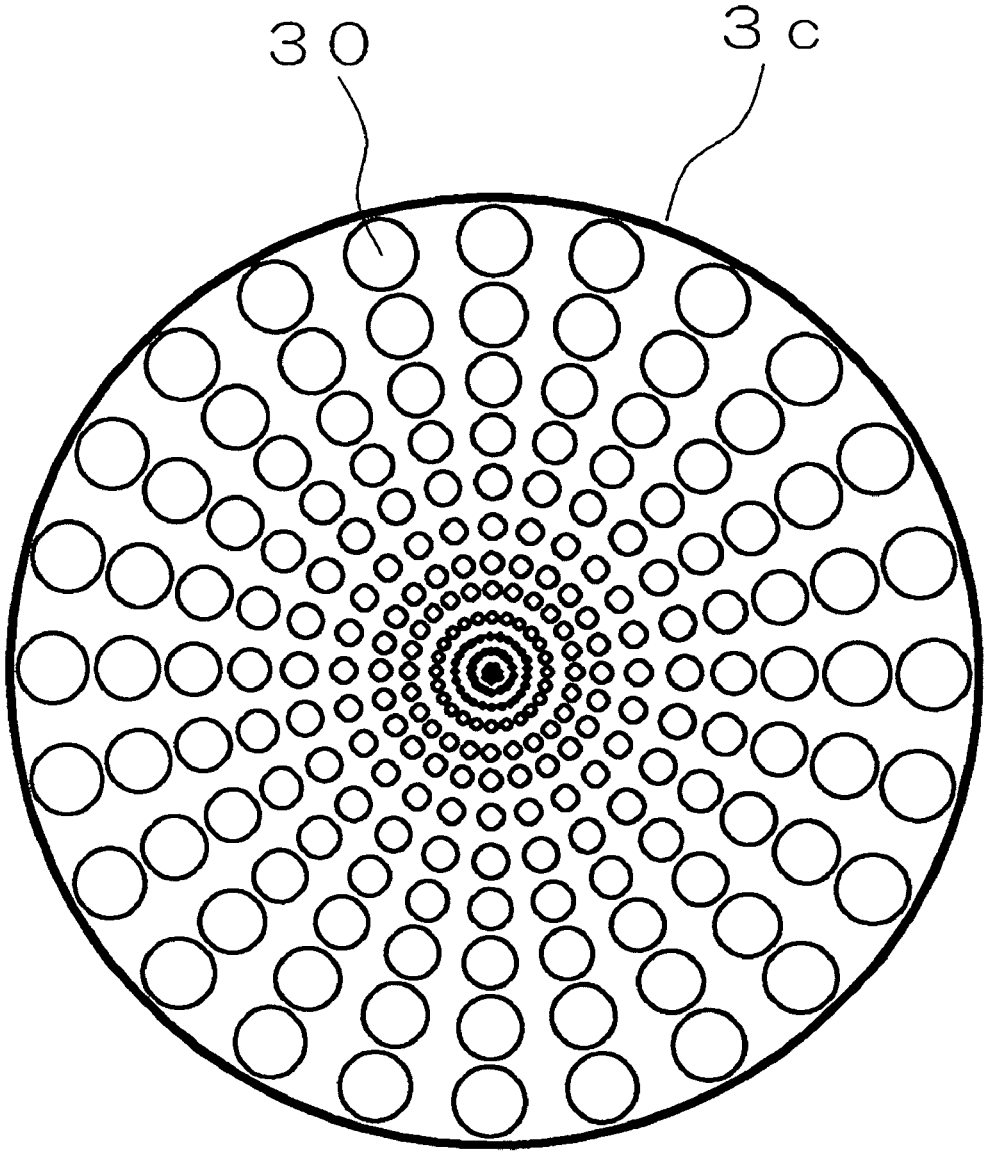
FIG. 2 is a diagram showing the shape of a stack in another embodiment.
Figure 3:
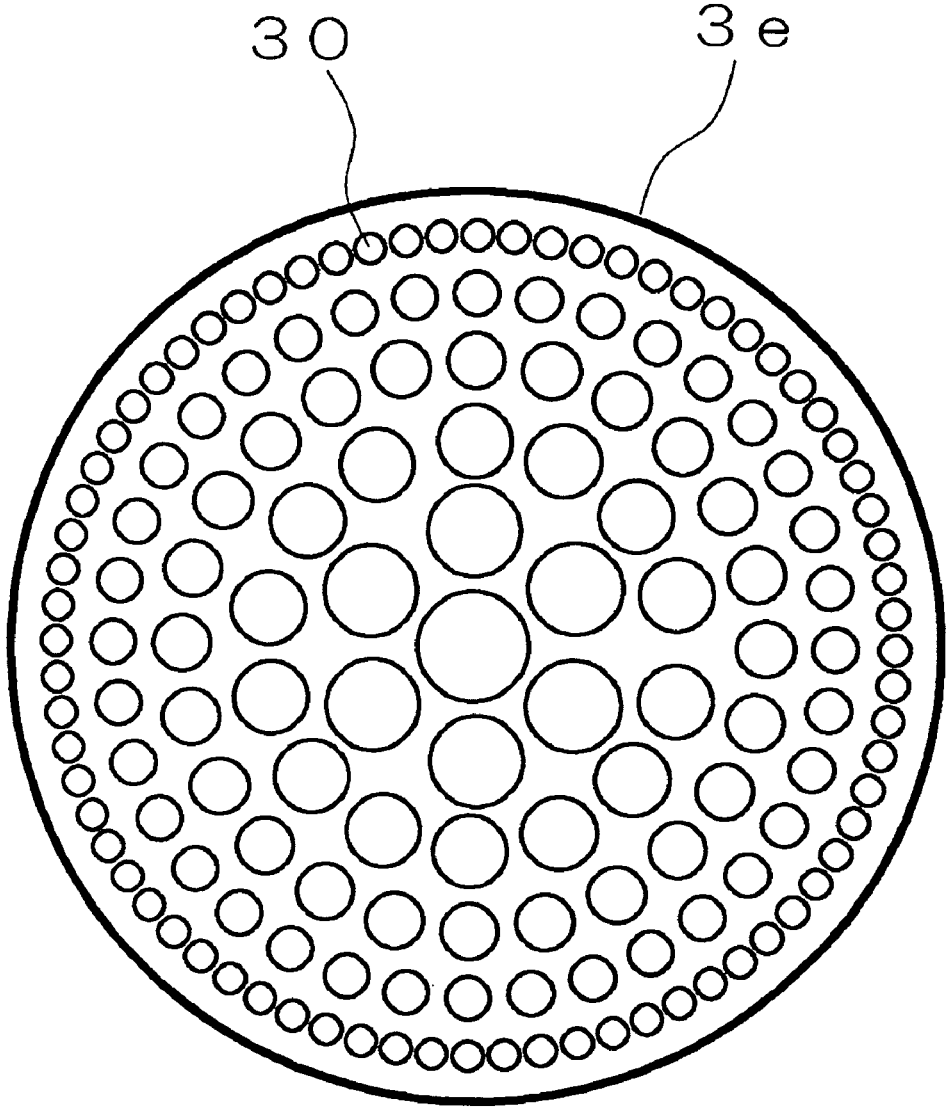
FIG. 3 is a diagram showing the shape of a stack in another embodiment.
Figure 4:
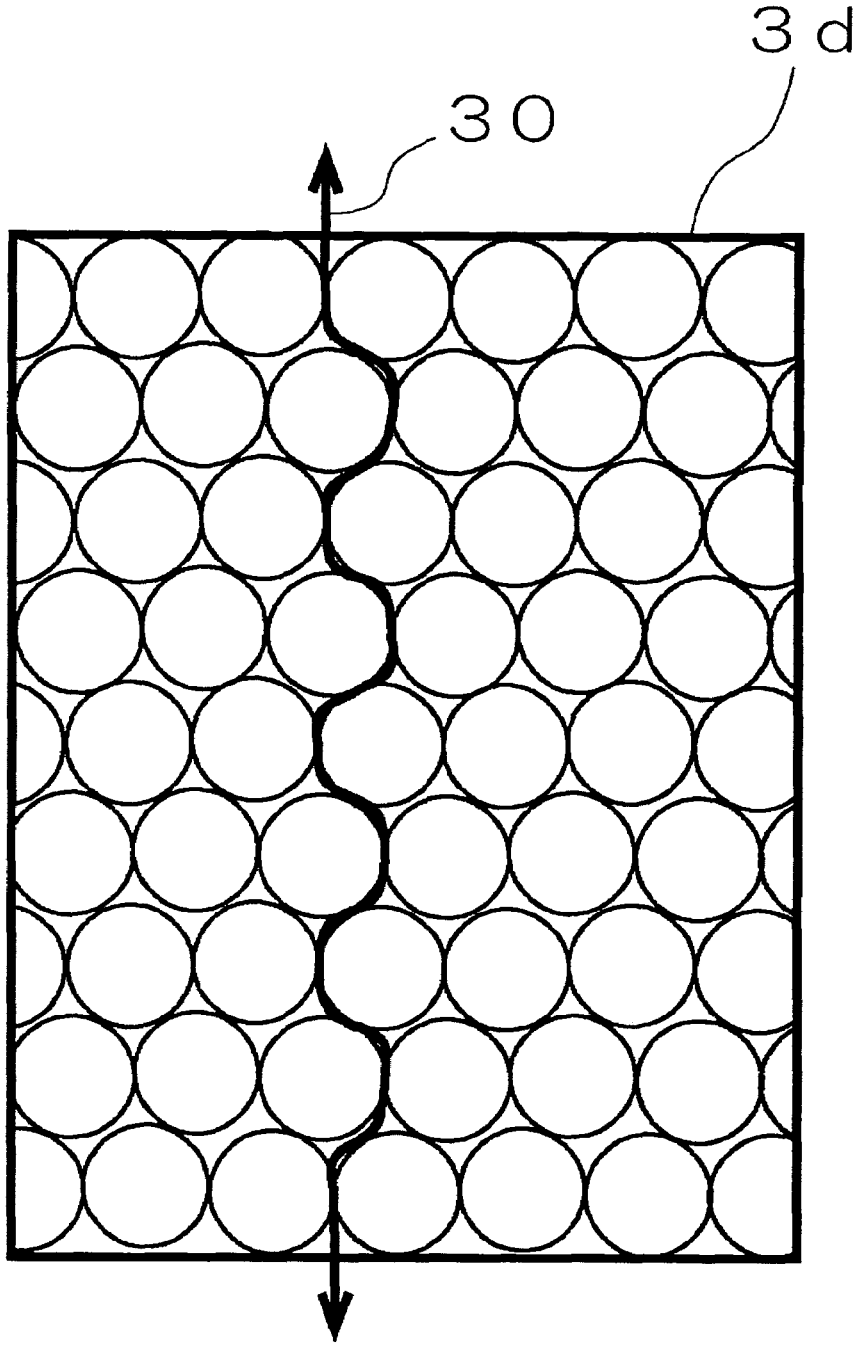
FIG. 4 is a diagram showing the shape of a stack in another embodiment.
Figure 5:
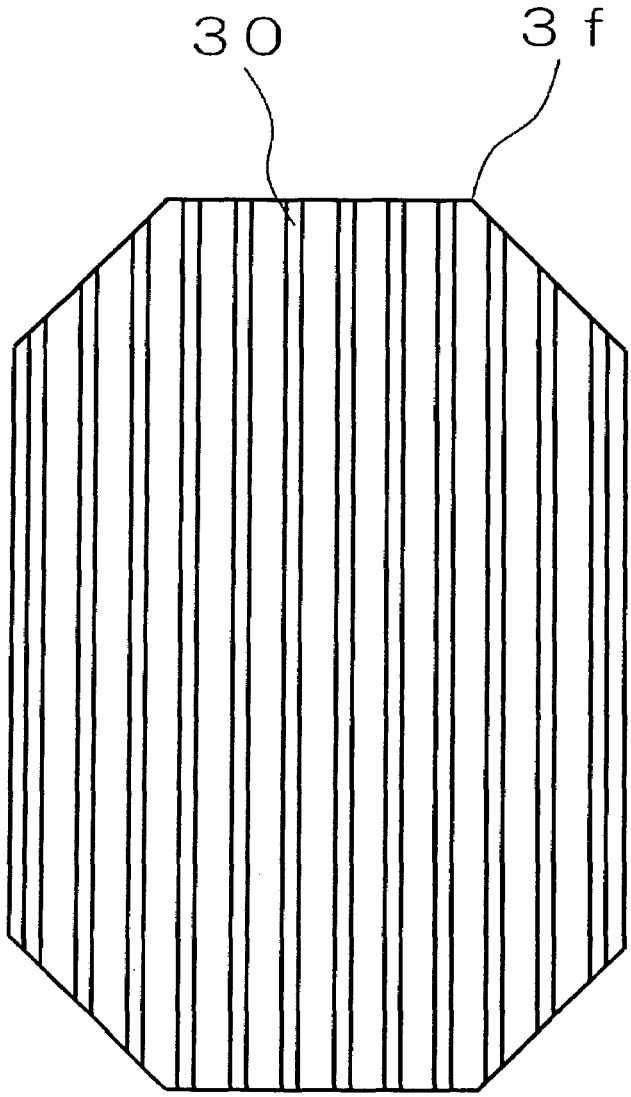
FIG. 5 is a diagram showing the shape of a stack in another embodiment.
Figure 6:
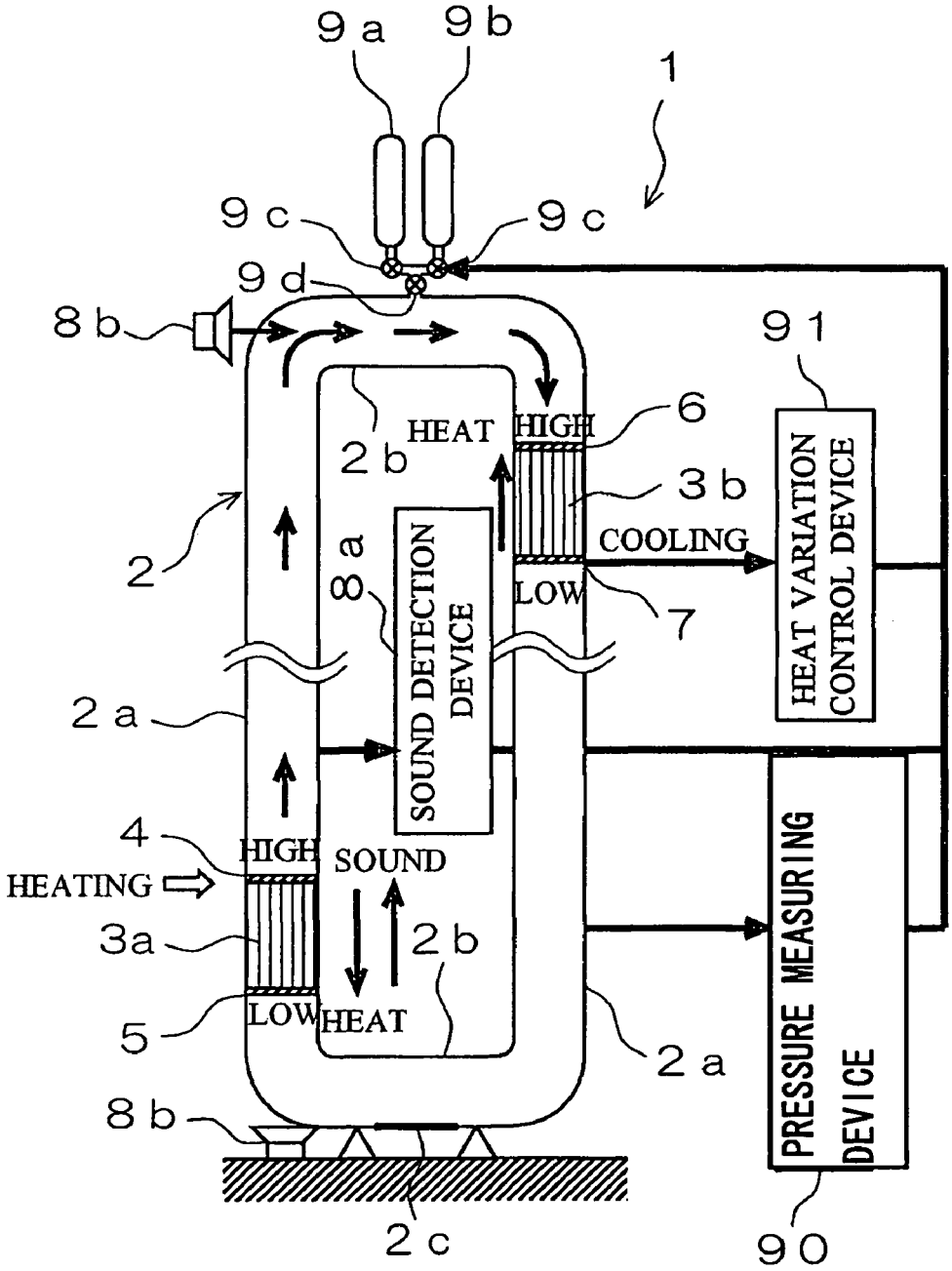
FIG. 6 is a schematic diagram of a thermoacoustic apparatus including a sound detection device, a pressure measuring device, and a heat variation control device.
Figure 7:
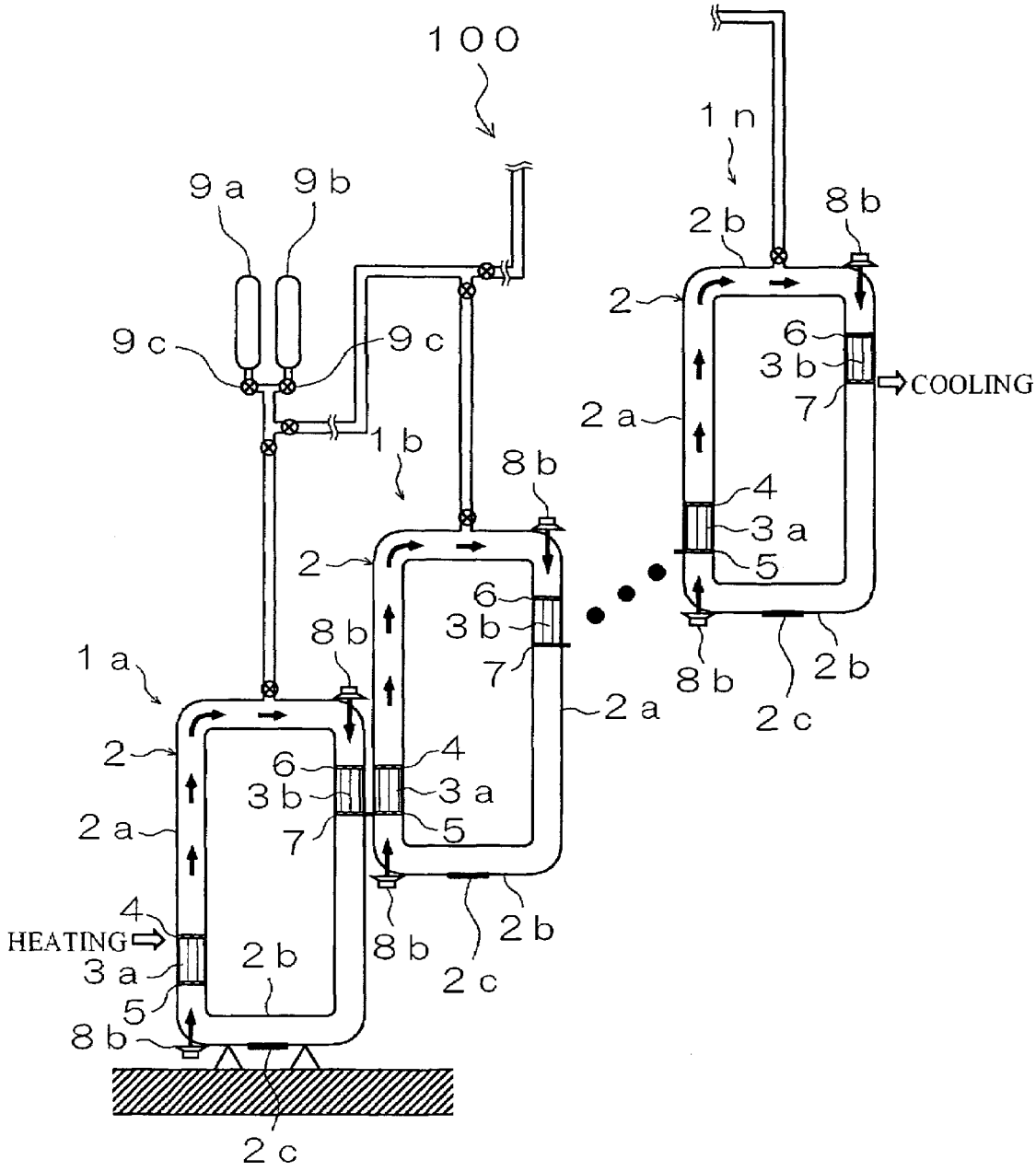
FIG. 7 is a schematic diagram of an acoustic heating system in which acoustic heating apparatuses are connected.
Figure 8:
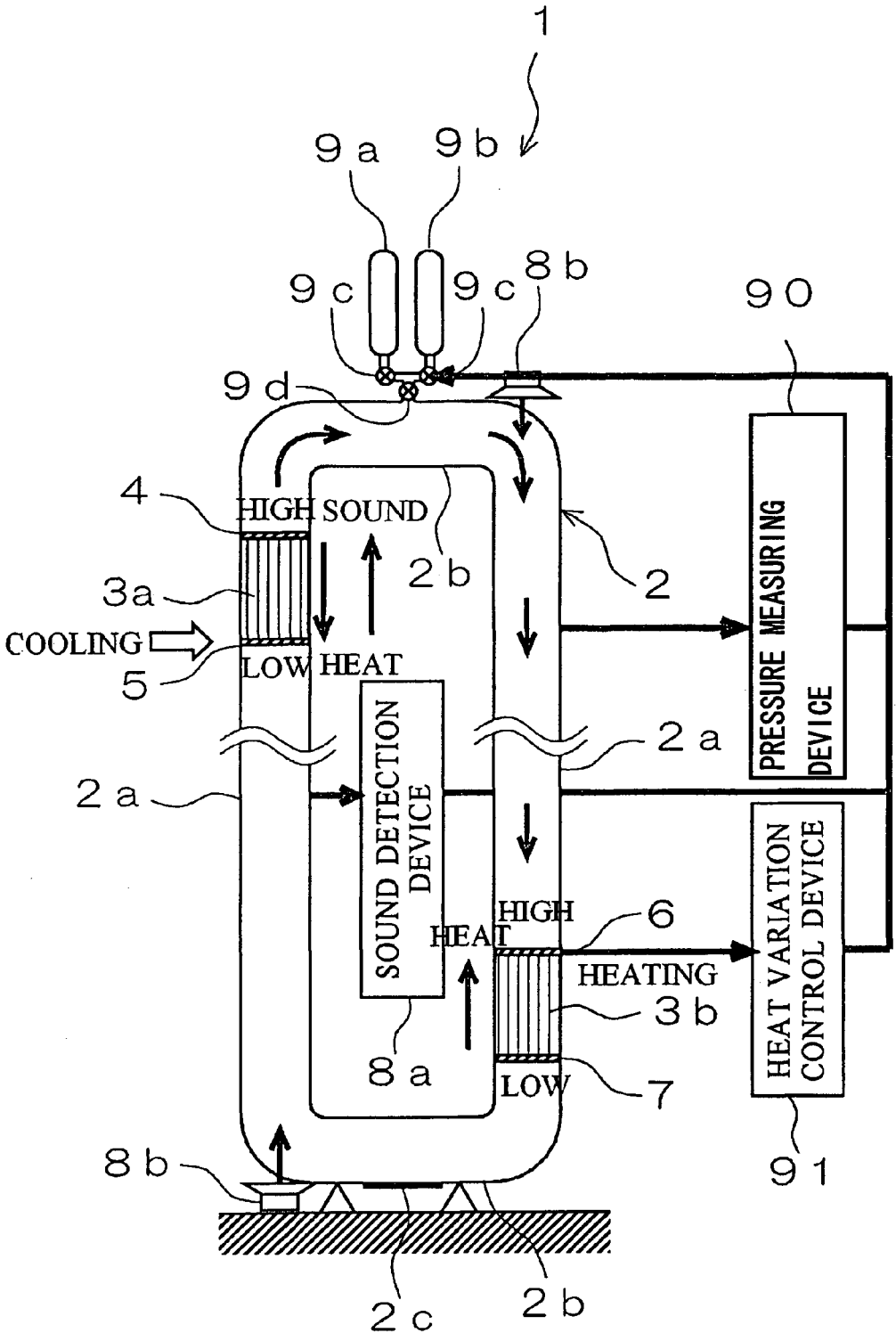
FIG. 8 is a schematic diagram of a thermoacoustic apparatus in another embodiment.

1 . . . thermoacoustic apparatus
2 . . . loop tube
2*a* . . . linear tube portion
2*b* . . . connection tube portion
2*c* . . . opening portion
3*a* . . . first stack
3*b* . . . second stack
3*c* . . . c stack
3*d* . . . stack
3*e* . . . stack
3*f* . . . stack
30 . . . connection channel
4 . . . first high-temperature-side heat exchanger
5 . . . first low-temperature-side heat exchanger
6 . . . second high-temperature-side heat exchanger
7 . . . second low-temperature-side heat exchanger
8*a* . . . sound detection device
8*b* . . . acoustic wave generator
9*a* . . . helium gas injection apparatus
9*b* . . . argon gas injection apparatus
9*c* . . . valve
9*d* . . . injection hole

90 . . . pressure measuring device
91 . . . heat variation control device
100 . . . thermoacoustic system

The invention claimed is:

1. A thermoacoustic apparatus comprising;

a first stack sandwiched between a first high-temperature-side heat exchanger and a first low-temperature-side heat exchanger;

a second stack sandwiched between a second high-temperature-side heat exchanger and a second low-temperature-side heat exchanger in the inside of a loop tube, wherein a standing wave and a traveling wave are generated through self excitation by heating the first high-temperature-side heat exchanger, the second low-temperature-side heat exchanger is cooled by the standing wave and the traveling wave, or/and a standing wave and a traveling wave are generated by cooling the first low-temperature-side heat exchanger, and the second high-temperature-side heat exchanger is heated by the standing wave and the traveling wave, wherein a first working fluid is enclosed in the inside of the loop tube; and a mixing device for injecting and mixing a second working fluid different from the first working fluid after the first working fluid is enclosed in the inside of the loop tube.

2. The thermoacoustic apparatus according to claim 1, wherein the mixing device is a device for injecting the second working fluid, which has a low sound velocity, afterward into the first working fluid, which has a high sound velocity, enclosed in the loop tube in advance.

3. The thermoacoustic apparatus according to claim 1, wherein the mixing device is a device for injecting the second working fluid, which has a large specific gravity, afterward into the first working fluid, which has a small specific gravity, enclosed in the loop tube in advance.

4. The thermoacoustic apparatus according to claim 1, wherein the mixing device is a device for injecting the second working fluid, which has a large Prandtl number, afterward into the first working fluid, which has a small Prandtl number, enclosed in the loop tube in advance.

5. The thermoacoustic apparatus according to claim 1, wherein the loop tube comprises a plurality of linear tube portions, which stand relative to the ground, and connection tube portions connected between the plurality of linear tube portions, and the mixing device is disposed above the center of the loop tube.

6. The thermoacoustic apparatus according to claim 1, wherein the loop tube is configured to be bilaterally symmetric and comprise a plurality of linear tube portions, which stand relative to the ground, and connection tube portions connected between the plurality of linear tube portions, and the mixing device is disposed at the center of the upper connection tube portion.

7. The thermoacoustic apparatus according to claim 1, wherein a sound detection device for detecting generation of a sound is disposed, and injection of the second working fluid is started when the generation of the standing wave and the traveling wave is detected by the detection device or when a variation in the acoustic wave state is detected.

8. The thermoacoustic apparatus according to claim 1, wherein a pressure measuring device for measuring a pressure in the loop tube is disposed, and injection of the second working fluid is stopped when a predetermined pressure is measured with this pressure measuring device.

9. The thermoacoustic apparatus according to claim 1, wherein the mixing device stops the injection of the second working fluid on the basis of the variation over time of heat output from the second high-temperature-side heat exchanger or the second low-temperature-side heat exchanger.

10. The thermoacoustic apparatus according to claim 1, wherein the loop tube includes the first working fluid lighter than air and the second working fluid heavier than air, and wherein an opening portion for releasing the second working fluid heavier than air is disposed at the lower end of the loop tube.

* * * * *